US007802629B2

(12) United States Patent
Freitag et al.

(10) Patent No.: US 7,802,629 B2
(45) Date of Patent: Sep. 28, 2010

(54) FIRE PROTECTION SYSTEM

(75) Inventors: Ruediger Freitag, Etterwinden (DE); Gerrit Panzner, Rudolstadt (DE); Jens Klossek, Weimar (DE); Ruediger Kopp, Cologne (DE)

(73) Assignees: Schott AG, Mainz (DE); Forteg Brandschutz GmbH & Co. KG, Koeln (DE)

( * ) Notice: Subject to any disclaimer, the term of this patent is extended or adjusted under 35 U.S.C. 154(b) by 403 days.

(21) Appl. No.: 10/589,716

(22) PCT Filed: Feb. 17, 2005

(86) PCT No.: PCT/EP2005/001606

§ 371 (c)(1),
(2), (4) Date: Apr. 3, 2008

(87) PCT Pub. No.: WO2006/039948

PCT Pub. Date: Apr. 20, 2006

(65) Prior Publication Data

US 2008/0190626 A1 Aug. 14, 2008

(30) Foreign Application Priority Data

Feb. 20, 2004 (DE) ..... 10 2004 009 529

(51) Int. Cl.
*A62C 8/00* (2006.01)

(52) U.S. Cl. ..... 169/49; 169/48; 169/16; 169/37; 169/54; 239/208; 239/566; 52/168

(58) Field of Classification Search ..... 169/16, 169/37, 48, 49, 54, 64, 70, DIG. 2; 239/208, 239/209, 565, 566; 405/132; 428/920, 921; 52/2.22, 168
See application file for complete search history.

(56) References Cited

U.S. PATENT DOCUMENTS

| | | | | |
|---|---|---|---|---|
| 1,620,142 | A * | 3/1927 | Thompson | 169/16 |
| 1,936,732 | A * | 11/1933 | Renard | 239/208 |
| 3,605,900 | A | 9/1971 | Livingston et al. | |
| 3,754,600 | A * | 8/1973 | Miller | 169/48 |
| 5,990,023 | A | 11/1999 | Siedel et al. | |
| 6,167,971 | B1 * | 1/2001 | Van Lingen | 169/16 |
| 6,779,309 | B2 * | 8/2004 | Sundolm | 49/1 |
| 6,884,160 | B1 * | 4/2005 | Sundholm | 169/48 |
| 2003/0230413 | A1 | 12/2003 | Usmanov et al. | |

FOREIGN PATENT DOCUMENTS

| | | | |
|---|---|---|---|
| CN | 1626256 | * | 6/2005 |
| DE | 1 951 218 | | 6/1970 |
| DE | 31 06 110 | | 9/1982 |

(Continued)

OTHER PUBLICATIONS

DIN EN 1363-1 "Fire Resistance Tests: Part 1 General Requirements." ICS 13.220.50. 49 Pages. Oct. 1999. European Committee for Standardization: CEN. Sep. 1977 Edition.

(Continued)

*Primary Examiner*—Steven J Ganey
(74) *Attorney, Agent, or Firm*—Michael J. Striker

(57) ABSTRACT

The invention relates to a fire protection system consisting of a first fire protection barrier in the form of a fire protection glass pane provided with preferably monolithic glass panels (1), and a device (2) for spraying water in the form of a water spray haze (7), in front of the fire protection glass pane. The inventive fire protection system ensures, in the event of a fire, that an additional transparent fire protection barrier is provided, that heat and smoke in the room (4) swept through by the fire mix together, and that exposed escape routes, inter alia, are thus protected from dangerous heat radiation (9). The inventive fire protection system can be used in very different fields of application, e.g. for interior glass panes or screens.

9 Claims, 4 Drawing Sheets

FOREIGN PATENT DOCUMENTS

Figure 1:
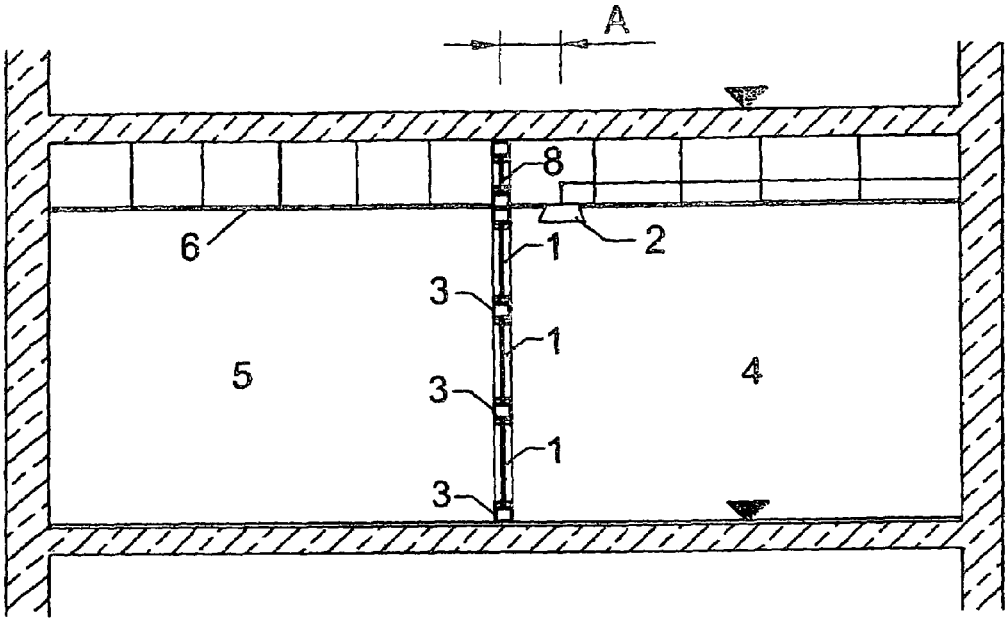

| | | |
|---|---|---|
| DE | 32 34 968 | 3/1984 |
| DE | 197 10 289 | 5/1998 |
| DE | 196 40 537 | 6/2002 |
| DE | 101 45 136 | 4/2003 |
| DE | 203 10 976 | 11/2003 |
| EP | 0 658 677 | 6/1995 |
| EP | 1 255 021 | 11/2002 |
| JP | 2003111858 | 4/2003 |
| WO | 01/69028 | 9/2001 |

OTHER PUBLICATIONS

DIN EN 1363-2 "Fire Resistance Tests: Part 2 Alternative and Additional Procedures." ICS 13.220.50. 15 Pages Oct. 1999. European Committee for Standardization: CEN. Sep. 1977 Edition, and DIN 4102-11, Dec. 1985 Edition.

Sub-Committe on Fire Protection 47-th Session, Agenda Item 1, Dec. 18, 2002 (in Eng.).

Sub-Committe on Fire Protection 47-th Session, Agenda Item 8, Oct. 8, 2002 (in Eng.).

Sub-Committe on Fire Protection 47-th Session, Agenda Item 8, Nov. 14, 2002 (in Eng.).

Sub-Committe on Fire Protection 47-th Session, Agenda Item 8, Dec. 3, 2002 (in Eng.).

Sub-Committe on Fire Protection 47-th Session, Agenda Item 8, Nov. 4, 2002 (in Eng.).

Sub-Committe on Fire Protection 47-th Session, Agenda Item 14, Nov. 26, 2002 (in Eng.).

Sub-Committe on Fire Protection 47-th Session, Agenda Item 8, Feb. 13, 2003 (in Eng.).

Sub-Committe on Fire Protection 47-th Session, Agenda Item16, Feb. 14, 2003 (in Eng.).

Sub-Committe on Fire Protection 48-th Session, Jan. 12-16, 2004 (in Eng.).

Sub-Committe on Fire Protection 48-th Session,Agenda Item 1, Jun. 30, 2003 (in Eng.).

Sub-Committe on Fire Protection 48-th Session,Agenda Item 5,Oct. 10, 2003 (in Eng.).

Sub-Committe on Fire Protection 48-th Session,Agenda Item 5,Jan. 14, 2004 (in Eng.).

DIN EN 1634-3 Jan. 2005, "Fire Resistance Tests for Door and Shutter Assemblies: Part 3 Smoke Control Doors and Shutters". 20 Pages. European Committee for Standardization:I CEN. ICS 13.220. 50; 91.060.50. Jan. 2005.

DIN EN 1364-1, "Fire Resistance Tests for Non-Loadbearing Elements: Part 1: Walls" ICS 13.220.50. European Committee for Stardardization: CEN. Oct. 1999. 31 Pages.

DIN EN 1364-2, "Fire Resistance Tests for Non-Loadbearing Elements: Part 2: Ceilings." 18 Pages. ICS 13.22.50, Oct. 1999. 18 Pages. European Committee for Standardization: CEN.

DIN EN 1634-1 "Fire Resistance Tests for Door and Shutter Assemblies: Part 1; Fire Doors and Shutters." 66 Pages. ICS 13.22.50. European Committee Standardization-CEN. Mar. 2000.

DIN EN 1634-2:2004-04. English Abstract. Fire Resistance and Smoke Control Tests for Door and Shutter Assemblies, Openable Windows and Elements of Building Hardware: Part 2: Fire Resistance Characterization Test for Elements of Building Hardware; German Version PREN 1634-2:2006. Oct. 2006. 65 Pages.

DIN EN 1364-3 Berichtigung 1. "Fire Resistance Tests for Non-Loadbearing Elements: Part 3: Cuertain Walling." Mar. 2007. ICS 13.220.50. 30 Pages. European Committee for Standardization. Dec. 2006.

DIN EN 1364-4. "Fire-Resistance Tests for Non-Loadbearing Elements Part 4: Curtain Walling." Jun. 2007. ICS 13.220.50; 91.060.10. Mar. 2007. European Committee for Standardization. 44 Pages.

* cited by examiner

FIRE PROTECTION SYSTEM

The present invention relates to a fire protection system for ensuring that a space inside a building is sealed off in a light-permeable, fire-resistant manner.

Fire protection barriers are required for many areas inside buildings per statutory fire protection codes. When glass panes are used in these areas inside buildings, e.g., as glass panes in doors or windows, they must also be in compliance with fire codes.

Conventional window panes, i.e., soda-lime panes, are unsuitable for use as fire protection barriers, because they blow out when subjected to high thermal load. The fire and the resultant thermal radiation could spread uninhibited. The reasons for this are their relatively high thermal expansion coefficients and their relatively low tensile strength.

The industry therefore developed a large variety of fire protection glass panes that resist fire, at least for a certain period of time. The fire protection glass panes are the subject of numerous relevant patents that are based on the principle of attaining fire protection by using particularly heat-resistant, transparent fire protection panels, e.g., made of glass ceramic or heat-tempered glass, and using specified configurations and retaining devices. The term "fire protection glass panes" is therefore understood to mean components and systems composed of one or more light-permeable glass panel fields installed in a frame with retaining devices and seals.

Fire protection glass panes do not all have the same level of fire resistance. The level of fire resistance is selected based on the particular application and is expressed in the relevant codes as the "fire-risk category". The different fire-risk categories for glass panes are EI, EW and E. Glass panes are further characterized by also specifying their fire endurance, in minutes (e.g., EW 30, EI 90, E 30). "E" glass panes only prevent fire and smoke from spreading, for the period of time indicated. "EW" glass panes must also prevent the passage of thermal radiation. "EI" glass panes are also required to prevent the temperature of the glass surface on the side opposite to the fire from increasing beyond a certain extent.

Common commercial "E" glass panes have the advantage of having a narrow design with a large surface area and high transparency, but they have considerable disadvantages when fire breaks out. Large portions of the thermal load occurring on the side facing the fire pass through the transparent glass pane in the form of thermal radiation (0.8-400 μm) and therefore affect persons and the surroundings in the potential escape zone, even though the fire is on the other side. Depending on the radiant energy density, persons can be injured, and flammable objects can even ignite.

"EW" and "EI" glass panes reduce this thermal radiation, but they are complicated and expensive to manufacture. The glass panes are thicker and less transparent, and they have ageing and stability problems. The maximum dimensions of the panels are limited due to production engineering and functionality. Depending on the type of glass pane, toxic fumes are also formed when fire breaks out.

The object of the present invention, therefore, is to design the fire protection system described initially such that it combines the advantages of "E" glass panes with the thermal radiation protection required for rescue routes and escape spaces.

This object is attained according to the present invention by providing a fire protection system for ensuring that a space inside a building is sealed off in a light-permeable, fire-resistant manner, with

- a fire protection glass pane of fire-risk category E as the first fire protection barrier, and
- a fire-activated, water spray system installed inside the building, with outlet nozzles on at least one side of the fire protection glass pane, which are oriented relative to the fire protection glass pane such that a curtain-like water spray haze can be applied directly in front of the fire protection glass pane as an additional, light-permeable fire protection barrier for absorbing heat.

The present invention is based on the finding that cooling and radiation absorption—that is, the necessary protection against thermal radiation—in the space where the fire is not burning can be attained by using finely-distributed water droplets when it is possible to create a sustained water "curtain" in front of the fire protection glass pane on the side where the fire is not burning. Since it is impossible to prevent cold water particles from coming in contact with the fire protection glass pane, which is hot, the resultant strong temperature gradient in the glass typically causes the glass in the fire protection glass pane to break, and the sealing-off of the space in which the fire is burning is therefore lost. Surprisingly, it has been shown, however, that, when monolithic glass panels are used for the fire protection glass panes in combination with a haze of superfine water spray according to the present invention, the fire protection glass panes do not break due to cooling. The inventive system therefore has the central advantage that, if fire breaks out, a heat-absorbing water spray haze can be applied directly in front of the fire protection glass pane, without the glass pane breaking. Furthermore, the advantage is attained that toxic fumes are washed away and the fire protection glass pane is cooled. Due to the inventive water spray, therefore, persons are not injured and escape routes are kept clear.

Due to the water spray haze that is applied in front of the fire protection glass panel, the fire protection system is therefore—to great advantage—bumped up into the next-higher EW classification, without the need to put up with the structural disadvantages of an EW glass pane.

The inventive fire protection system cannot be compared with a sprinkler system, which sprays water—in a distributed manner and in large volumes—in a room, as described, e.g., in DE 196 40 537 C2. This publication also shows how sprinklers are positioned along a glass facade. The sprinklers typically do not produce water spray. Water spray is defined per fire protection codes as occurring when water droplets are <1000 μm in size. In the case of the present invention, however, when fire breaks out in a relatively small space, an additional transparent, curtain-like fire protection barrier composed of superfine spray droplets is created in front of the fire protection glass pane.

Publication DE 101 45 136 A1 made known a system for providing bulkheads against fire and smoke in railroad structures, e.g., in a tunnel, the system including two arcuate spraying tubes located a specified distance apart and designed to match the contour of the entire cross-section of the area to be protected, water being supplied thereto constantly and under high pressure and creating a curtain of water spray over the cross-section of the area. For this fire protection barrier to be used, however, fire protection doors and gates and, therefore, fire protection glass panes cannot be used; the water curtain is intended to replace them, by definition.

A comparable fire protection barrier with a water spray curtain is also described in abstract JP 2003/1111 858 A1, according to which the average size of the water droplets of the spray is between 40 and 400 μm. A fire-protection folding door was made known in DE 32 34 968 A1, with which the door frame and profile are cooled with water that is directed through hollow spaces. The door panel can also be sprayed with water from the outside. The purpose of these measures is to prevent the fire protection door from warping if fire breaks out.

In a preferred embodiment of the present invention, a fire protection glass pane composed of monolithic glass panels—made of heat-tempered borosilicate glass in particular—is used for the fire protection system, the monolithic glass panels being wetted and covered with a high-pressure water spray when fire breaks out. In this configuration, the thermal radiation from the area where the fire is burning is absorbed—to great advantage—by the water spray haze, which also washes away toxic fumes. In addition, high fire endurance of the fire protection glass pane is attained via the cooling, which occurs simultaneously. Tempered soda-lime-silica glasses can also be used.

Tempered, monolithic fire protection glasses were made known, e.g., in DE 197 10 289 C1.

Other glasses can also be used for the fire protection glass pane, e.g., aluminosilicate glasses, in particular those based on the LAS glass system (lithium aluminum silicate), or glass ceramics.

Glass partitions alone, or in combination with doors, can be configured within the framework of the present invention. A preferred embodiment of the present invention is characterized by the fact that a glazed door with transom light and side part abut a glass partition. Glass partitions of this type were made known, e.g., in EP 0 056 677 A1.

Further embodiments of the present invention are characterized in subclaims and result from the description of the figures.

The present invention is described in greater detail with reference to two exemplary embodiments of the inventive fire protection system depicted in the drawing.

Figure 2:
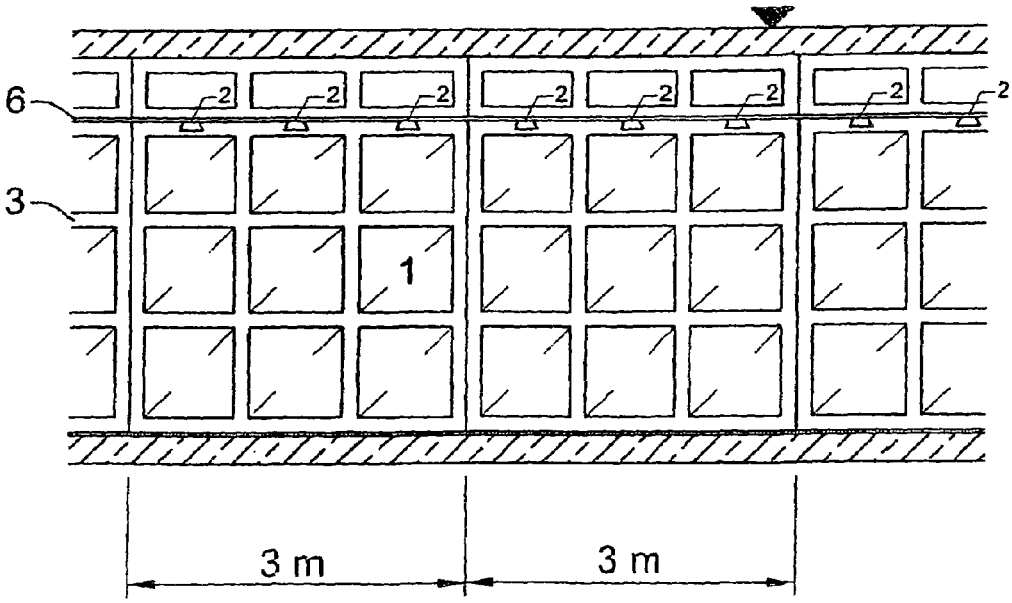
Figure 3:
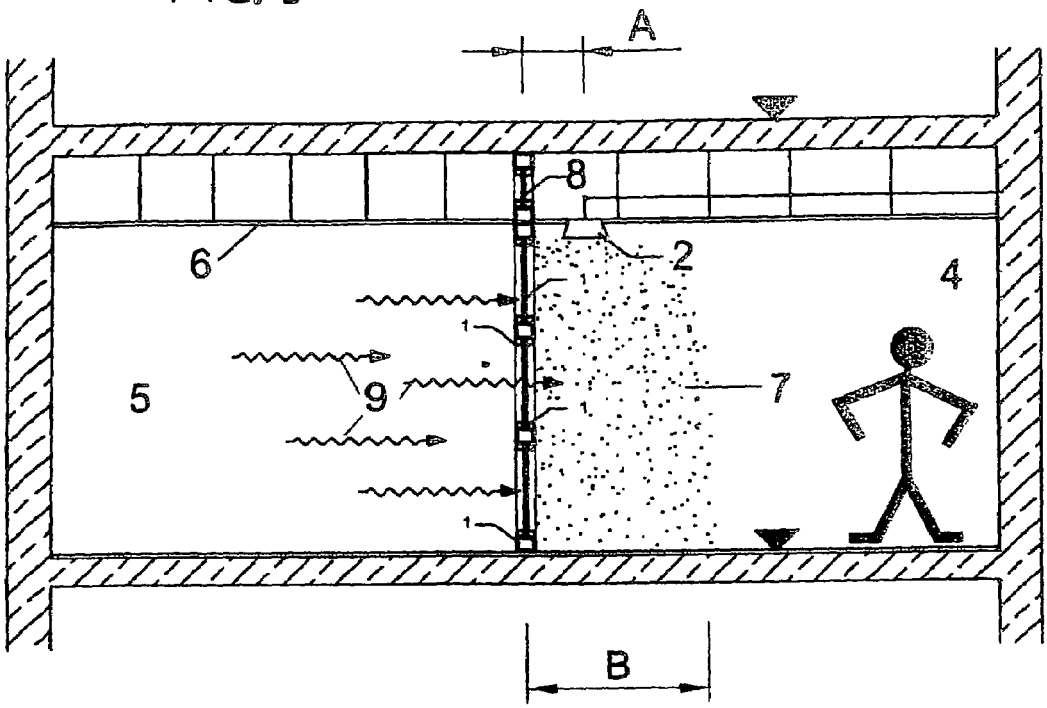
Figure 4:
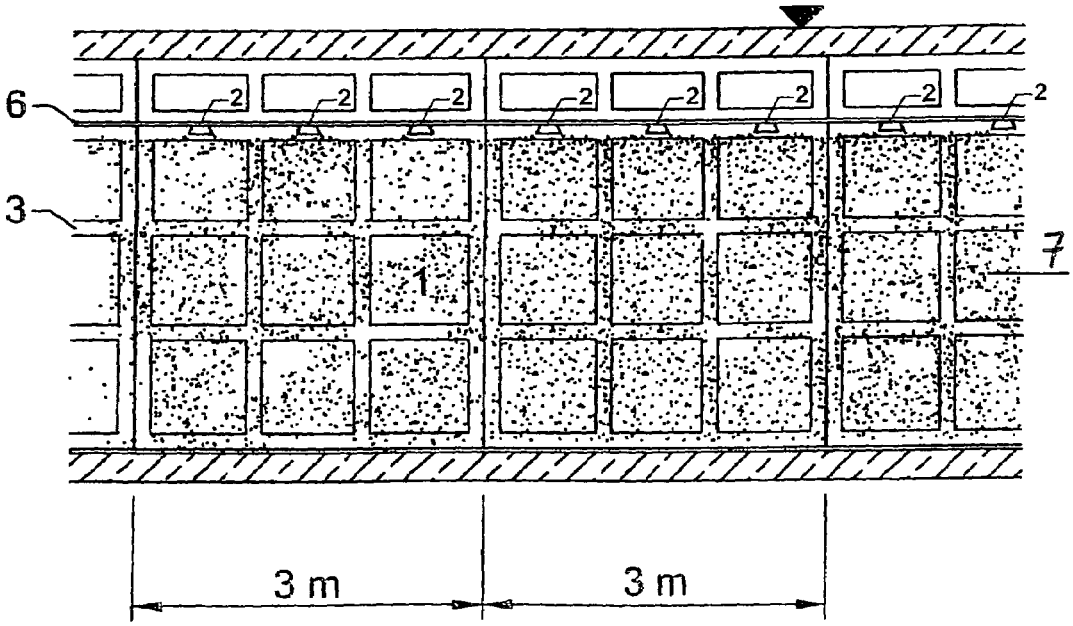
Figure 5:
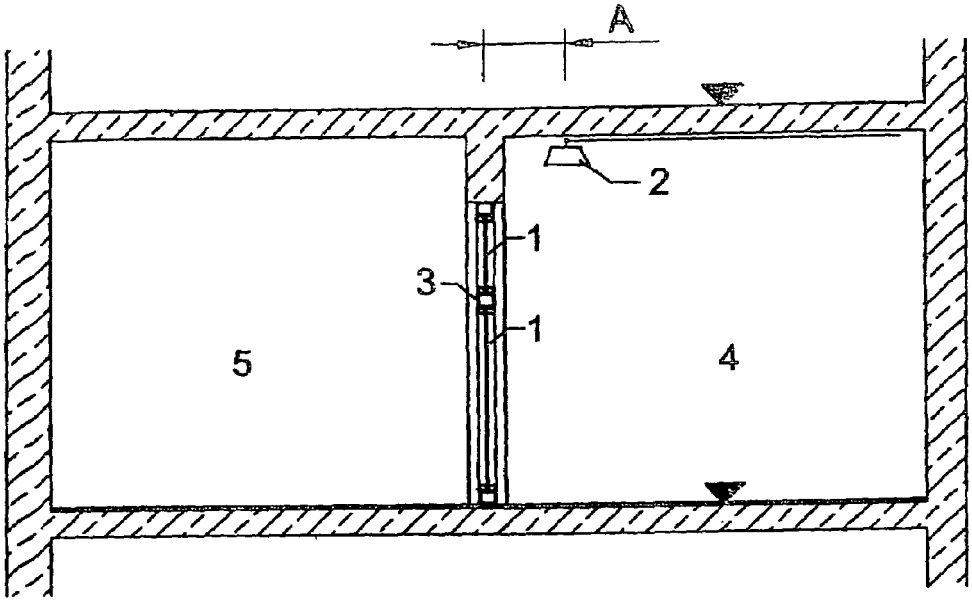
Figure 6:
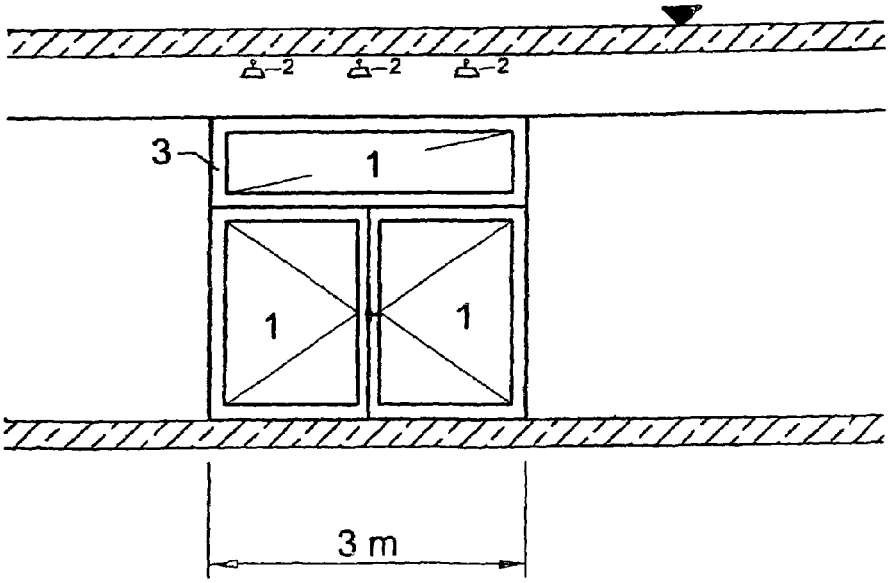
Figure 7:
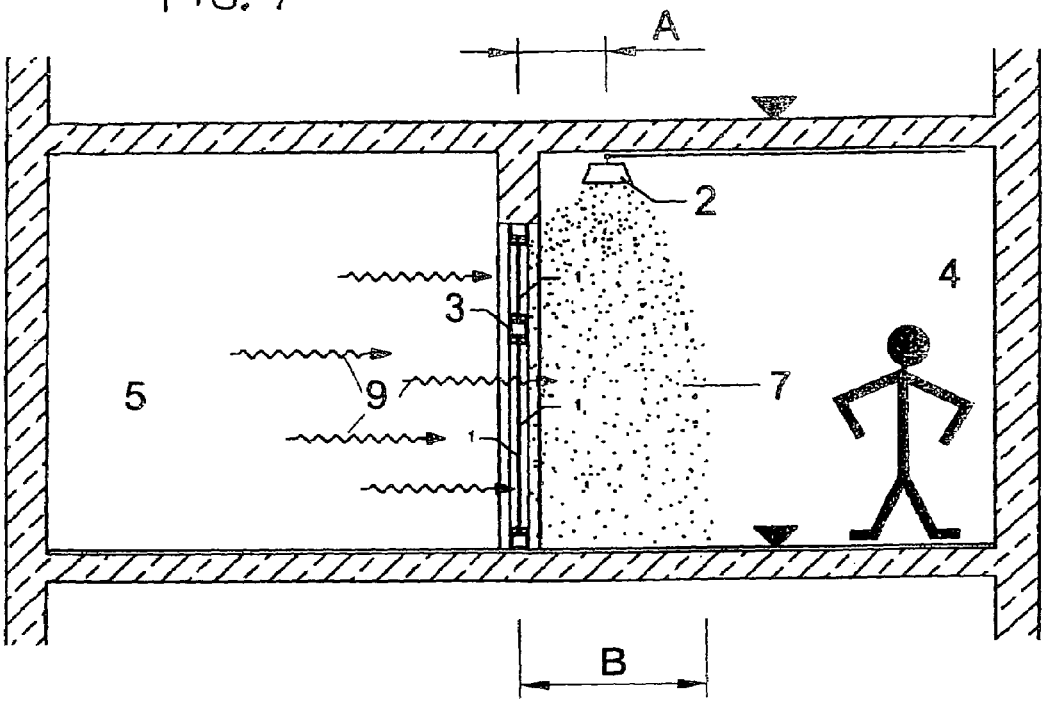
Figure 8:
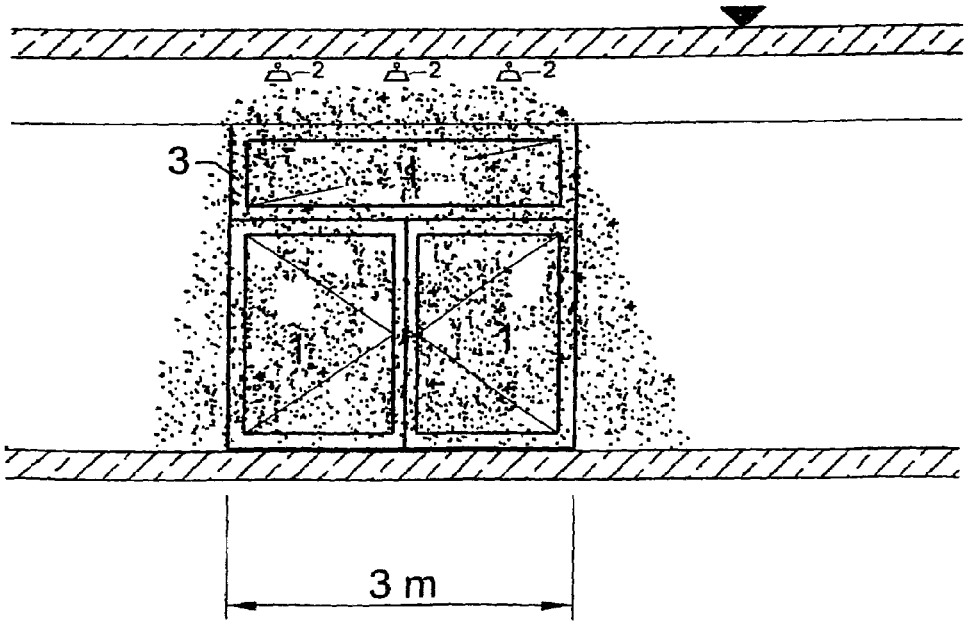

FIG. 1 shows, in a longitudinal cross section through a building, a space in which a fire is burning, and a space partitioned off from the room where the fire is burning, the two spaces being separated by a fire protection glass pane in the form of a glass partition to which a high-pressure water spray system is assigned—forming the fire protection system according to the present invention—to produce a water-spray curtain in front of the glass partition, which is shown in the "ready" state, FIG. 2 shows a front view of the glass partition and its associated high-pressure water spray system in FIG. 1, FIG. 3 shows the first embodiment of the fire protection system in FIG. 1 while a fire is burning, FIG. 4 shows the front view of FIG. 2 while a fire is burning, FIG. 5 shows, in a longitudinal, cross-sectional view of FIG. 1, a second embodiment of the inventive fire protection system in the "ready" state, the fire protection system including a double door and a transom, FIG. 6 shows a front view of the fire protection system in FIG. 1 and its associated high-pressure water spray system, FIG. 7 shows the second embodiment of the fire protection system in FIG. 5 while a fire is burning, and FIG. 8 shows the front view of FIG. 6 while a fire is burning.

FIGS. 1 through 4 show a first exemplary embodiment of the inventive system in a floor of an office building with a false ceiling 6, a row of offices, space 5 in which the fire is burning, and a space 4 in which the fire is not burning, which serves as the escape and rescue route. The two rooms are separated by an E 60 fire protection glass pane in the form of a statically non-self-supporting glass partition that protects space 4 in which the fire is not burning. This glass partition is designed, e.g., with nine sections in a three-meter frame element.

Fire protection glass pane is composed of a large number of monolithic glass panels 1 made of borosilicate glass with associated frame, seal and retaining device 3. It is shown as a cross section in FIGS. 1 and 3, and in a front view in FIGS. 2 and 4.

The term "monolithic glass panel" is intended to mean that a glass panel that is a continuous, single component, i.e., not laminated glass, is used.

In addition to this fire protection glass pane, which is composed of monolithic borosilicate glass panels, the inventive system also includes nozzles 2 for atomizing water to form water spray or a water spray haze 7, nozzles 2 being part of a high-pressure water spray system integrated in the space above false ceiling 6 with all of the supply lines, control systems and triggering mechanisms. Nozzles 2, which atomize (or spray) the supplied water to form a high-pressure water spray are installed in false ceiling 6 parallel to the glass partition at a distance "A" away from each other, e.g., 80 cm to 1 m, in the manner of a strip. False ceiling 6 is sectioned off above the glass partition by a fire protection panel 8, which serves as an upper panel for partitioning off space 4 where the fire is not burning.

Nozzles 2 are formed by special high-pressure water spray nozzles with a defined volumetric flow rate. The nozzles are positioned approximately one meter apart along the strip, that is, one nozzle is provided for each meter of partition. The operating pressure is provided by pump systems at a pressure that is a minimum of 100 bar at the nozzle with the least-favorable pressure engineering characteristics. On average, the water is sprayed at pressures between 10 and 200 bar to produce the water spray haze. The water is atomized using special micro-nozzles in the nozzle head, with which the spray pattern (spray angle), flow rate and droplet spectrum are adjusted. Atomization preferably takes place such that 90% of the sprayed water is contained in droplets <200 μm in size.

When fire breaks out (fire behavior test conducted as a standard fire per DIN EN 1363, 1364, 1634), the temperature in space 5 where the fire is burning increases extremely, resulting in intensive thermal radiation 9, which—in addition to thermal convection—acts on adjacent escape space 4. Transparent borosilicate panel 1 allows a majority of the IR radiation to pass. The heat effect on the side where the fire is not burning triggers the high-pressure water spray system. The atomization of water produces a water spray curtain 7 of width "B" directly in front of the fire protection glass pane, water spray curtain 7 absorbing the thermal radiation and cooling the panels in the fire protection glass pane and the space in which the fire is not burning. When fire breaks out, the integrity and transparency of the fire protection glass pane is therefore permanently ensured within the scope of the fire-risk category. In addition, the concentration of toxic fumes in the space where the fire is not burning is reduced because the toxic fumes are washed away by the water spray haze.

In the fire behavior test, a measurement of the radiant energy density served as proof that thermal radiation was reduced. After 60 minutes, the resultant thermal radiation in space 4 where the fire was not burning was less than 15 $kW/m^2$ at a distance of 1 m away from the panel. Compared with an identical fire behavior test carried out without the use of a water spray haze, this means thermal radiation is reduced to approximately 25% of the conventional value.

FIGS. 5-8 show a second exemplary embodiment of the inventive fire protection system, which is identical to that depicted in the first exemplary embodiment in terms of the building (except for false ceiling 6), but which does not include a glass partition as E 60 fire protection glass pane, but rather a double door with steel frame 3 and a transom, both of which include panels 1 composed of a monolithic glass. As in the first case, this fire protection glass pane primarily protects space 4 where the fire is not burning, which serves as the escape and rescue route. Nozzles 2 of high-pressure water spray system are installed parallel to the door element—which is approximately 3 m wide—approximately 80 cm apart from each other, with their supply line directly in the ceiling.

The explanations provided for FIGS. 1 through 4 apply for the rest with regard for the design and mode of operation of the fire protection system.

In both of the exemplary embodiments presented, the high-pressure water spray system is installed with its nozzles 2 on the side of the particular fire protection glass pane where the fire is not burning. Other embodiments are also feasible, however, with which the high-pressure water spray system is installed on the side where the fire is burning, or on both sides of the fire protection glass pane.

In both inventive exemplary embodiments, a system is therefore described that is composed of a fire protection glass pane with monolithic glass panels and a device for spraying water to form a water spray haze, which ensures that an additional transparent fire protection barrier will be provided if fire breaks out, that absorbs heat and toxic gases and therefore protects exposed rescue routes from dangerous thermal radiation and toxic gas. The system according to the present invention can be used in highly diverse applications, e.g., for interior glass panes, doors, and partitions.

LIST OF REFERENCE NUMERALS

1 Monolithic glass panel, part of the fire protection glass pane
2 Nozzle, as part of the device for spraying a high-pressure water spray
3 Profiled frame with seal and retaining device, part of the fire protection glass pane
4 Space where the fire is not burning, escape route
5 Space where the fire is burning
6 False ceiling
7 High-pressure water spray, spray haze
8 Upper panel for partitioning off the space above the false ceiling (fire protection panel)
9 Thermal radiation

What is claimed is:

1. A fire protection system for ensuring that a space inside a building is sealed off from another space in the building in a light-permeable, fire-resistant manner, said fire protection system comprising:

a fire protection glass pane of fire-risk category E as a first fire protection barrier arranged to seal off said space from said another space, and a fire-activated, water spray system installed in the building, with high-pressure water spray outlet nozzles (2) for atomizing water on at least one side of the fire protection glass pane, which are oriented relative to the fire protection glass pane such that a curtain-like water spray haze (7) can be applied directly in front of the fire protection glass pane as an additional, light-permeable fire protection barrier for absorbing heat;

wherein the high-pressure water spray outlet nozzles are arranged on a ceiling and in front of and spaced from the fire protection glass pane; and wherein said curtain-like water spray haze (7) extends from said ceiling to a bottom end of said fire protection glass pane and has a width (B) in a direction perpendicular to the fire protection glass pane that is from 10 cm to 200 cm.

2. The fire protection system as recited in claim 1, wherein the outlet nozzles (2) are oriented such that the fire protection glass pane is also at least partially wetted by the water spray haze (7).

3. The fire protection system as recited in claim 1, wherein the outlet nozzles (2) are designed such that 90% of the water sprayed from the nozzles is contained in droplets <200 pm in size.

4. The fire protection system as recited in claim 1, wherein the water spray system is designed to spray the water at pressures from 10 to 200 bar to produce the water spray haze comprising water droplets.

5. The fire protection system as recited in claim 1, wherein the fire protection glass pane is composed of monolithic glass panels and the monolithic glass panels are composed of soda-lime-silica glass, thermally or chemically tempered borosilicate glass, or tempered aluminosilicate glass, or glass ceramic.

6. The fire protection system as recited in claim 1, wherein the outlet nozzles (2) are installed on a rail on the ceiling parallel to the fire protection glass pane and a distance (A) between the nozzles and the fire protection glass pane is between 30 and 200 cm.

7. The fire protection system as recited in claim 1, wherein said width (B) of the water spray haze is at least 50 cm and at most 100 cm.

8. The fire protection system as recited in claim 1, wherein the fire protection glass pane is designed as a glass partition.

9. The fire protection system as recited in claim 1, wherein the fire protection glass pane is designed as a glass partition in combination with a glazed door.

* * * * *

UNITED STATES PATENT AND TRADEMARK OFFICE

CERTIFICATE OF CORRECTION

PATENT NO. : 7,802,629 B2
APPLICATION NO. : 10/589716
DATED : September 28, 2010
INVENTOR(S) : Freitag et al.

It is certified that error appears in the above-identified patent and that said Letters Patent is hereby corrected as shown below:

Title Page;

Column 1, Section 73 Delete "Forteg" and substitute 'Fogtec'

Signed and Sealed this
Twenty-fourth Day of May, 2011

David J. Kappos

David J. Kappos
*Director of the United States Patent and Trademark Office*